United States Patent [19]

Häusler et al.

[11] Patent Number: 4,718,614

[45] Date of Patent: Jan. 12, 1988

[54] LIFTING MECHANISM FOR A CRUSHER

[75] Inventors: Dietrich Häusler, Vellmar; Josef Weber, Melsungen, both of Fed. Rep. of Germany

[73] Assignee: Thyssen Industrie Aktiengesellschaft, Essen, Fed. Rep. of Germany

[21] Appl. No.: 893,588

[22] Filed: Aug. 6, 1986

[30] Foreign Application Priority Data

Aug. 7, 1985 [DE] Fed. Rep. of Germany ..... 3528288

[51] Int. Cl.[4] ..... B02C 13/282

[52] U.S. Cl. ..... 241/189 R; 241/285 B

[58] Field of Search ..... 241/73, 189 R, 285 R, 241/285 A, 285 B

[56] References Cited

FOREIGN PATENT DOCUMENTS 2019384 11/1971 Fed. Rep. of Germany .

3301186 9/1983 Fed. Rep. of Germany .

*Primary Examiner*—Mark Rosenbaum

*Attorney, Agent, or Firm*—Becker & Becker, Inc.

[57] ABSTRACT

Lifting mechanism for a crusher having a two-part machine housing and a horizontal rotor with striking tools, where the plane of separation between the lower housing part and the upper housing part of the machine extends through the plane of the central axis of the rotor, where the upper housing part of the machine can be raised about a pivot axis that is disposed parallel to the axis of the rotor via piston-cylinder units that are disposed on both sides, and can be fixed in the raised position, and where the base of each of the two rotor shaft bearing housings is detachably secured to a floor stand on the lower housing part of the machine; the piston of each piston-cylinder unit is pivotably connected with a pivot arm mounted on the side of the upper housing part of the machine, with the free end of each pivot arm being fixable, via a securing mechanism, on the upper housing part of the machine in two different positions, and with the underside of each pivot arm being provided with a coupling mechanism for coupling the rotor bearing housing.

5 Claims, 5 Drawing Figures

LIFTING MECHANISM FOR A CRUSHER

BACKGROUND OF THE INVENTION

The present invention relates to a lifting mechanism for a crusher or size-reducing machine having a two-part machine housing and a horizontal rotor with striking tools, where the plane of separation between the lower housing part and the upper housing part of the machine extends through the plane of the central axis of the rotor, where said upper housing part can be raised about a pivot axis that is disposed parallel to the axis of the rotor via respective piston-cylinder units that are disposed on both sides of the upper housing part, with the latter being capable of being fixed in the raised position, and where the base of each of the two rotor shaft bearing housings is detachably secured to a floor stand on the lower housing part.

For a crusher having a two-part machine housing, lifting mechanisms of this type serve to raise the upper housing part of the machine in order to be able to repair or replace crushing tools in the machine housing and/or on the rotor.

To replace parts that cooperate with the crushing of material, a lifting mechanism of the aforementioned type is disclosed, for example, in DE OS No. 33 01 186 (FIGS. 2 and 4). With this mechanism, the hood or upper housing part of the machine is raised by means of piston-cylinder units disposed on both sides, and the rotor, the bearing housings of which are connected to the lower housing part of the machine, remains in this machine housing part, so that the worn-out parts on the rotor can be replaced. In order to replace tools in the lower housing part of the machine, the connections between the base of the bearing housing and the floor stand must be disconnected, and the rotor, including its two bearing housings, must be lifted out of the lower housing part of the machine via a separate lifting device.

However, such lifting devices are not always available. Furthermore, placing not only the rotor but also its two bearing housings into the operating position in the lower housing part of the machine takes a lot of time, because this process must only be carried with a certain precision.

DE OS No. 20 19 384 discloses a crusher having a two-part machine housing and a horizontal rotor with cutting tools where the rotor bearing housings are secured in the upper, raisable housing part of the machine. The rotor, along with its two bearing housings, thus participates, during raising of the upper housing part of the machine, in the pivotal movement of the latter, whereby the rotor bearing housings assume different positions in the operating and raised position of the upper housing part of the machine. In so doing there exists the danger that the oil located in each bearing housing for lubricating the rotor bearings will leak out of the associated sump. When the crusher is operated further, the oil loss causes damage or even destruction of the bearings of the rotor shaft.

It is therefore an object of the present invention to provide a lifting mechanism of the aforementioned general type with which, in addition to raising the upper housing part of the machine, it is possible to raise the rotor, including its bearing housings, out of the lower housing part of the machine while retaining their position relative to one another.

SUMMARY OF THE INVENTION

This object is realized pursuant to the present invention by pivot arms that are disposed on opposite sides of the upper housing part, with each pivot arm having two ends, including a first end that is pivotably connected to the upper housing part, and a second free end, with the piston of each of the piston-cylinder units being pivotably connected with a respective one of the pivot arms; a securing mechanism that is provided on each of the pivot arms in the vicinity of the free end thereof; means provided on the upper housing part for cooperating with the securing mechanism to fix the free pivot arm end on the support housing part in two different positions; and a coupling mechanism that is provided on each of the pivot arms for coupling a respective one of the rotor bearing housings thereto.

The advantages achieved with the present invention consist in particular in that the raising of the upper housing part of the machine, and the independent raising of the rotor with its bearing housings out of the lower housing part of the machine, can be carried out with only a single lifting mechanism, which is in contrast to the heretofore known constructions. Since the lifting movements are effected independently of one another, it is also possible for this purpose to use smaller piston-cylinder units, which are considerably cheaper. Furthermore, the rotor bearing housings always retain a position that corresponds to the operating position, not only during lifting movements thereof but also in their fixed, raised position.

BRIEF DESCRIPTION OF THE DRAWINGS

One exemplary embodiment of the present invention is schematically illustrated in the drawings, and will be described in detail subsequently. Shown are FIG. 1 a side view of a crusher having a two-part closed machine housing and a horizontal rotor, with the inventive lifting mechanism, which is disposed on both sides, being in the starting position.

DESCRIPTION OF PREFERRED EMBODIMENTS

Figure 1:
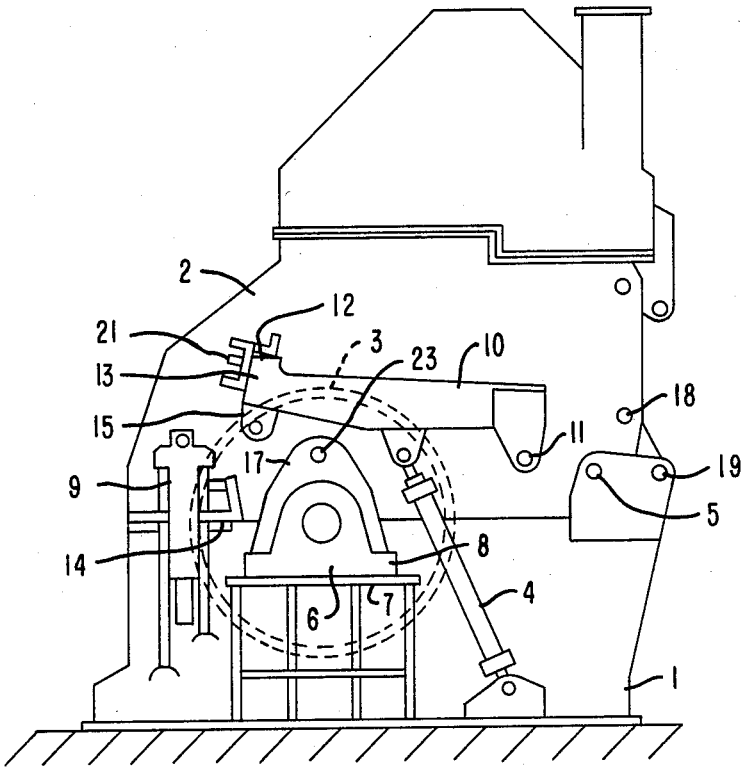

The crusher or size-reducing machine that is illustrated as an exemplary embodiment essentially comprises a two-part machine housing, including a lower housing part 1 and an upper housing part 2, as well as a horizontal rotor 3 that includes crushing tools that cooperate with crushing tools in the lower housing part 1.

A plane of separation is provided between the lower housing part 1 and the upper housing part 2 in the plane of the central axis of the rotor. The upper housing part 2 can be raised, about a pivot axis or shaft 5 that is disposed parallel to the rotor shaft, via piston-cylinder units 4 that are disposed on both sides. In the operating position, each bearing housing 6 located on both sides of the rotor 3 is supported on a floor stand 7, with the base 8 of each rotor bearing housing 6 being detachably connected to the pertaining floor stand 7. The two machine housing parts 1 and 2 are securely locked in the operating state via locking mechanisms 9 disposed on both sides on the lower housing part 1. A respective pivot arm 10 is disposed on each side of the upper housing part 2. One end of each pivot arm is pivotably connected to a journal 11 of the upper housing part, and approximately in the middle, each pivot arm is pivotably connected to a head of the piston rod of the piston-cylinder unit 4. A securing mechanism 12 is disposed on the upper side of the other end of each pivot arm 10. Depending upon the position of the pivot arm 10, this securing mechanism corresponds with either an upper cooperating piece 13 or a lower cooperating piece 14 on the upper housing part 2 of the machine. The upper cooperating piece 13 at the same time serves as a stop for the pivot arm 10. In the vicinity of the securing mechanism 12, the lower side of the pivot arm 10 is provided with a coupling mechanism 15 for the rotor bearing housing 6. The coupling mechanism 15 essentially comprises two parallel support members 16 and 16' that are designed to receive and support a carrying plate 17 of the rotor bearing housing 6. The upper portion of the carrying plate 17 is appropriately embodied for support of the rotor bearing housing 6.

Since the mechanisms on both housing sides of the machine are embodied in the same way and carry out synchronous movements, the operation of only one of these mechanisms will be described.

Figure 2:
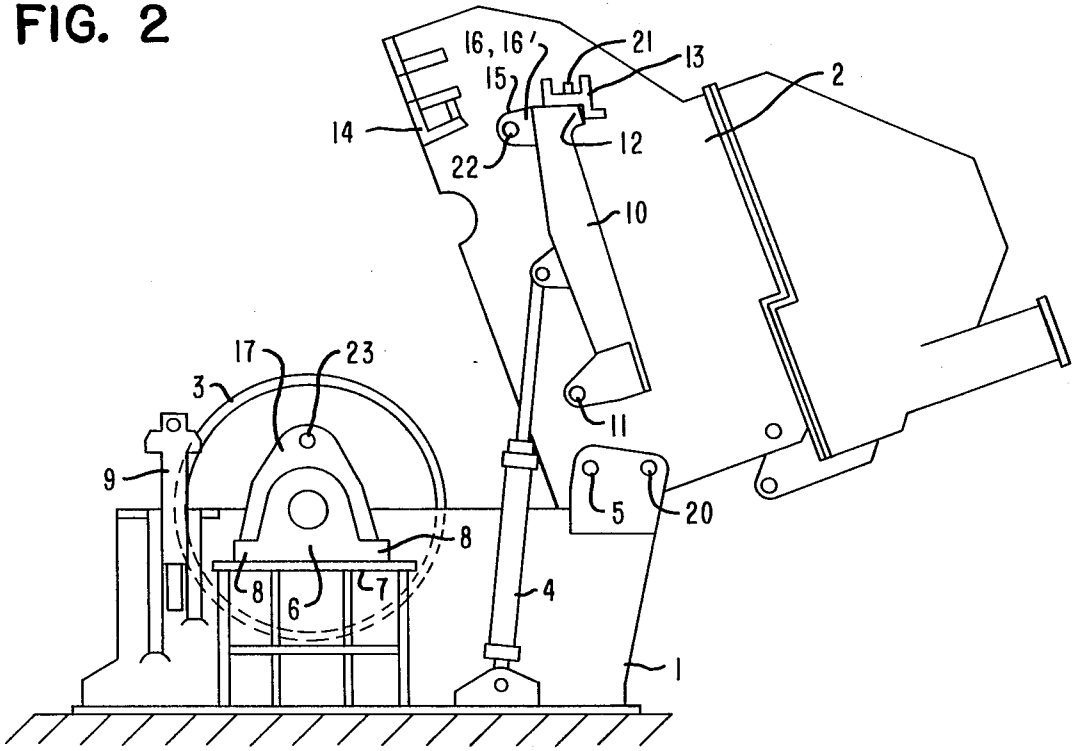
FIGS. 2–4 each an illustration similar to that of FIG. 1, with the upper part of the machine housing being raised and locked in position, and the lifting mechanism being in different positions.

To raise the upper housing part 2 of the machine from its locked operating position (FIG. 1), in which the securing mechanism 12 of the pivot arm 10 is connected to the upper cooperating piece 13, the locking mechanism 9 is loosened and swung to the side, and subsequently the piston-cylinder unit 4 is activated. As a consequence of the force exerted upon the upper housing part of the machine by the piston-cylinder unit 4 via the pivot arm 10, the upper housing part moves about the pivot axis 5, in the course of which an opening 18 in the upper housing part of the machine approaches an opening 19 associated with the pivot axis 5. When these two openings 18 and 19 are aligned with one another, a fixing pin 20 is inserted therein (FIG. 2). The rotor tools can now be repaired or replaced.

Figure 3:
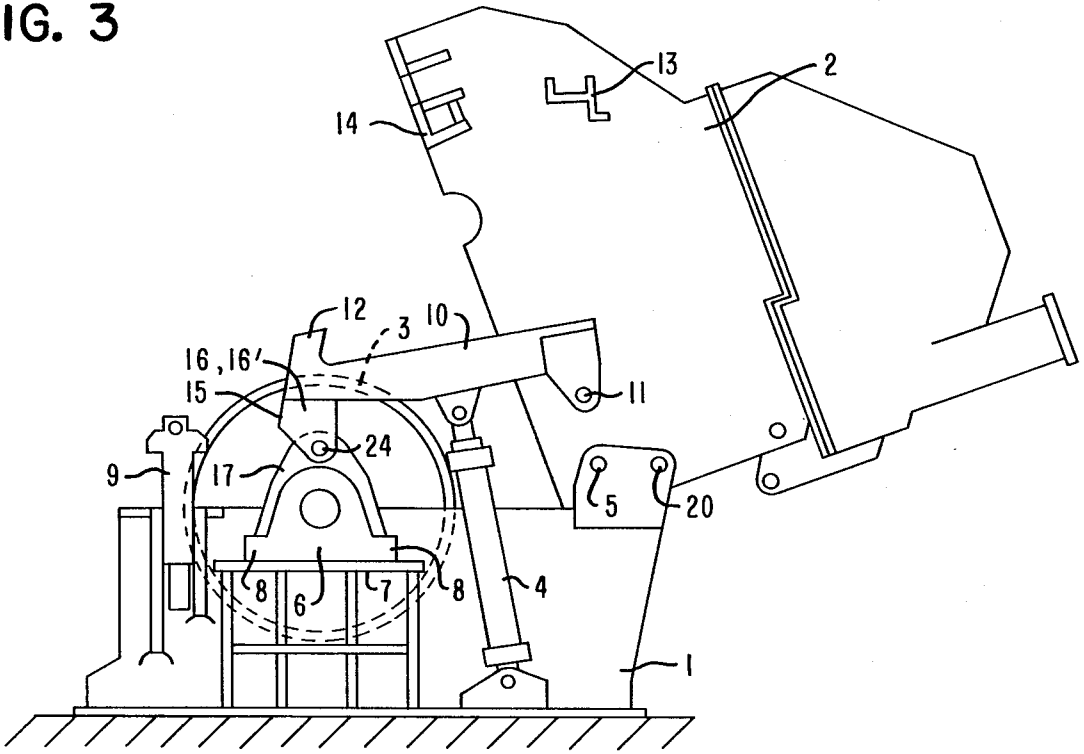
Figure 4:
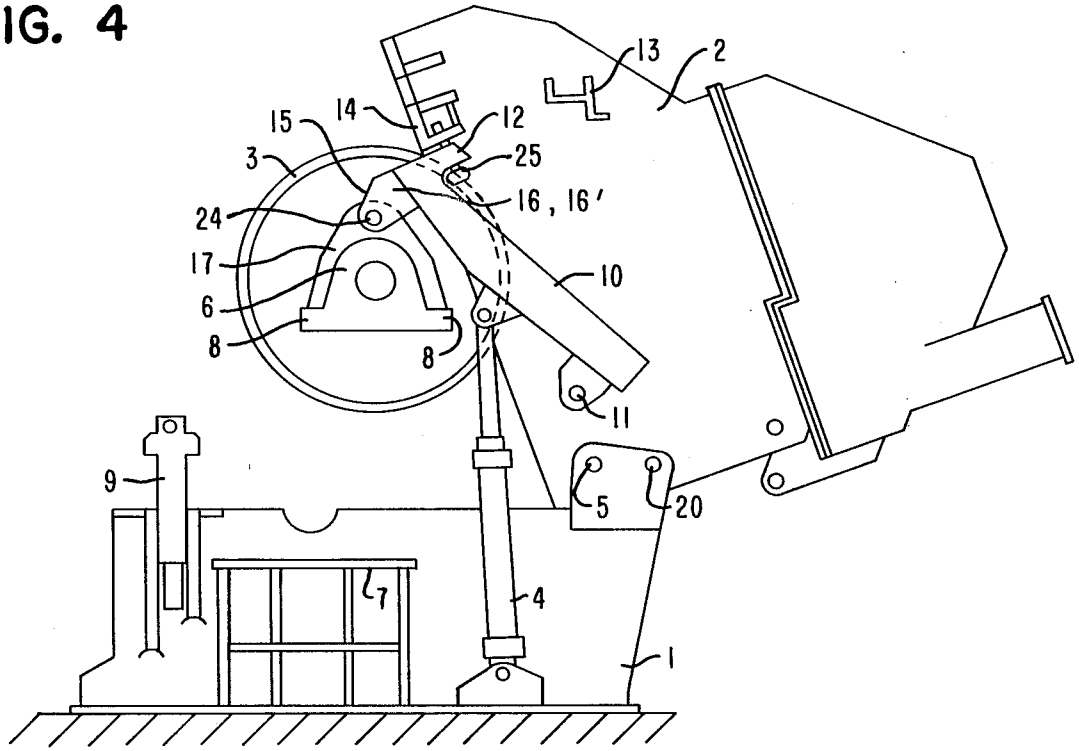

In the event that the tools in the lower housing part 1 of the machine are to be repaired or replaced, the upper housing part 2 of the machine remains in the secured, raised position (FIGS. 3 and 4), and the securing mechanism 12 of the pivot arm 10 is loosened from the upper cooperating piece 13 by removing a cotter-type pin 21. As the upper housing part 2 of the machine was raised, the pivot point of the pivot arm 10 also moved and assumed a different position relative to the pivot axis 5. The piston of the piston-cylinder 4 is returned to its starting position, thereby moving the pivot arm 10 into the position illustrated in FIG. 3. In this position, an opening 22 in the two support members 16, 16' of the coupling mechanism 15 is in alignment with an opening 23 in the carrying plate 17 of the bearing housing; a pin 24 is introduced into these aligned openings 22, 23. Subsequently, by activating the piston of the piston-cylinder unit 4, the pivot arm 10, along with the rotor bearing housing 6 and rotor 3 supported on the pivot arm, are moved upwardly into the position of FIG. 4. The securing mechanism 12 is now connected with the lower cooperating piece 14 on the upper housing part 2 via a cotter-type pin 25.

To assure a sufficient reliability when the upper housing part of the machine is raised, and in the various positions of the pivot arm, the fixing pins 20 and the other pins 21, 24, and 25, are protected from falling out.

The present invention is, of course, in no way restricted to the specific disclosure of the specification and drawings, but also encompasses any modifications within the scope of the appended claims.

What we claim is:

1. In a lifting mechanism for a crusher or size-reducing machine having a two-part machine housing and a horizontal rotor with striking tools, where the plane of separation between the lower housing part and the upper housing part of the machine extends through the plane of the central axis of said rotor, where said upper housing part can be raised about a pivot axis that is disposed parallel to the axis of said rotor via respective piston-cylinder units that are disposed on both sides of said upper housing part, with the latter being capable of being fixed in the raised position, and where the base of each of two rotor shaft bearing housings is detachably secured to a floor stand on said lower housing part, the improvement comprising:

pivot arms disposed on opposite sides of said upper housing part, with each pivot arm having two ends, including a first end that is pivotably connected to said upper housing part, and a second free end, with the piston of each of said piston-cylinder units being pivotably connected with a respective one of said pivot arms;

a securing mechanism provided on each of side of said pivot arms in the vicinity of said free end thereof;

means provided on said upper housing part for cooperating with said securing mechanism to fix said free pivot arm end on said upper housing part in two different positions; and a coupling mechanism provided on each of said pivot arms for coupling a respective one of said rotor bearing housings thereto.

2. A lifting mechanism according to claim 1, in which said means for cooperating with the securing mechanism of a given one of said pivot arms comprises an upper cooperating piece and a lower cooperating piece, both of which are attached to said upper housing part, with said securing mechanism being selectively connectable to one of said cooperating pieces.

3. A lifting mechanism according to claim 2, which includes removable pins for effecting said connection between said securing mechanism and one of said cooperating pieces.

4. A lifting mechanism according to claim 3, in which each of said rotor bearing housings includes a carrying plate, and in which each of said coupling mechanisms is provided with two parallel and spaced apart support members for receiving said carrying plate.

5. A lifting mechanism according to claim 4, in which each carrying plate is provided with an opening, and each of said support members is provided with an opening, with said openings of said support members being aligned with one another and being adapted to be aligned with said opening of said carrying plate; and which includes a further pin that is inserted through said openings of said support members and said opening of said carrying plate, when these three openings are aligned with one another, to couple said support members and said carrying plate together.

* * * * *